United States Patent [19]

Burgio Di Aragona

[11] Patent Number: 4,748,948

[45] Date of Patent: Jun. 7, 1988

[54] INTERNAL COMBUSTION ENGINE FOR MOTOR VEHICLES

[75] Inventor: Antonio Burgio Di Aragona, Turin, Italy

[73] Assignee: Fial Auto S.p.A., Turin, Italy

[21] Appl. No.: 25,024

[22] Filed: Mar. 12, 1987

[30] Foreign Application Priority Data

Mar. 13, 1986 [IT] Italy ..... 67199 A/86

[51] Int. Cl.[4] ..... F02F 7/00

[52] U.S. Cl. ..... 123/195 R

[58] Field of Search ..... 123/195 R

[56] References Cited

U.S. PATENT DOCUMENTS 3,046,953 7/1962 Dolza ..... 123/195 R 3,166,992 1/1965 Francis ..... 123/195 R 4,370,951 2/1983 Pomfret ..... 123/195 R 4,610,229 9/1986 Wissmann ..... 123/195 R

*Primary Examiner*—Douglas Hart

*Attorney, Agent, or Firm*—Sughrue, Mion, Zinn, Macpeak, and Seas

[57] ABSTRACT

An internal combustion engine for motor vehicles in which the main journals for the crankshaft are rotatably supported by main bearings including upper portions fixed to the engine block and lower caps joined to the upper portions by pairs of tie-rods anchored at one end to the cylinder head and interconnected at their opposite ends by respective brackets which surround and clamp the caps against the upper portions of the respective main bearings.

4 Claims, 3 Drawing Sheets

INTERNAL COMBUSTION ENGINE FOR MOTOR VEHICLES

Figure 1:
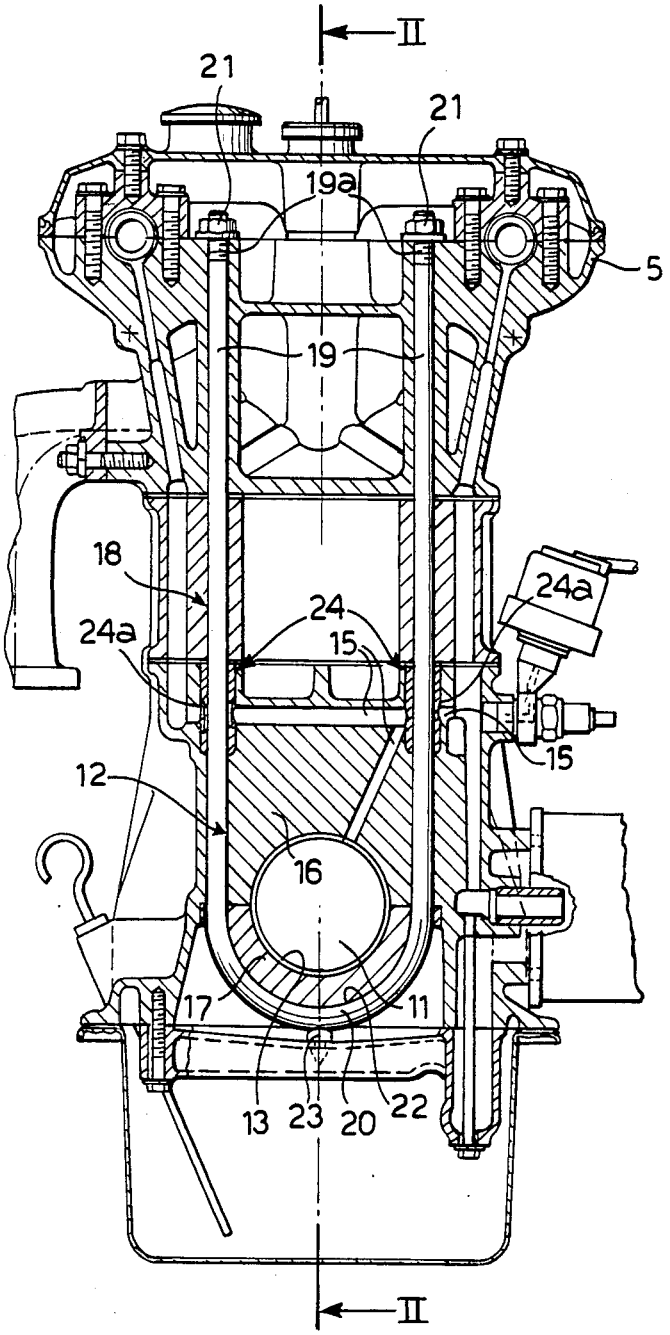

The present invention relates to internal combustion engines for motor vehicles, of the type including an engine block carrying a plurality of cylinders which are closed at their upper ends by a head fixed to the block by tie-rods and in which there are reciprocable pistons connected by respective connecting rods to a crankshaft having main journals supported for rotation by the block in correspondence with respective main bearings, each including an upper portion fixed to the block and a lower cap joined to the upper portion by removable connecting members.

In internal combustion engines of the type defined above, the tie-rods for fixing the head are anchored to respective bosses in the head itself and the main bearing caps are usually joined to the upper portions of the corresponding main bearings by pairs of bolts inserted through suitable coupling flanges.

This solution has various disadvantages resulting from the manner of fixing of both the head and the main bearing caps. With regard to the fixing of the head, the use of bosses for anchoring the tie-rods involves constructional complications in the block, as well as an increase in the weight of the structure, so as to ensure the necessary resistance to the clamping forces of the tie-rods themselves. Moreover, this clamping may cause deformation of the barrels of the cylinders during closing of the head.

With regard to the connection of the main bearing caps, their complicated structures are made more complex by the fact that the caps must necessarily be formed with very strong structures to limit the effects thereon of bending forces and the risk of their ovalization under load.

The object of the present invention is to avoid these disadvantages and this object is achieved by virtue of the fact that the members for connecting each main bearing cap are constituted by a pair of tie-rods anchored at one end to the head and interconnected at their opposite ends by a bracket which surrounds and clamps the main bearing cap against the upper portion of the respective main bearing.

By virtue of this characteristic, a series of important advantages is achieved, which can be summarised as follows:

the function of withstanding operating loads is entrusted totally to the tie-rods interconnected by their brackets, which makes it possible to use a lighter and structurally simpler structure for the engine block and the cylinder block, any risk of deformation of the barrels as a result of closure of the head is eliminated in that the tie-rods and their brackets are free of the engine block;

the main bearing caps are no longer subject to bending forces in that they are surrounded by their brackets and can therefore have light structures, for example, of high-pressure die-cast aluminium;

the main bearing caps surrounded by their brackets do not ovalize under load and the knocking noise noticeable in conventional engines after a more or less long working life is thus eliminated;

perfect equilibrium of closure (clamping torque) of the head is achieved.

According to the invention, the brackets may be formed integrally with the tie-rods or may be constituted by separate members joined to the lower ends of the tie-rods by threaded couplings.

Conveniently, the brackets are arcuate in shape and the main bearing caps have respective complementary peripheral housings in which the brackets are inserted with form couplings.

In order to simplify the removal of the head, resilient retaining members are provided between the brackets and the oil sump of the engine to bias the brackets into their complementary housings in the main bearing caps.

Moreover, the portions of the tie-rods which intersect passages formed in the engine block for the lubrication of the main journals have associated sealing bushes provided with outer annular grooves for the passage of the lubricant.

Figure 2:
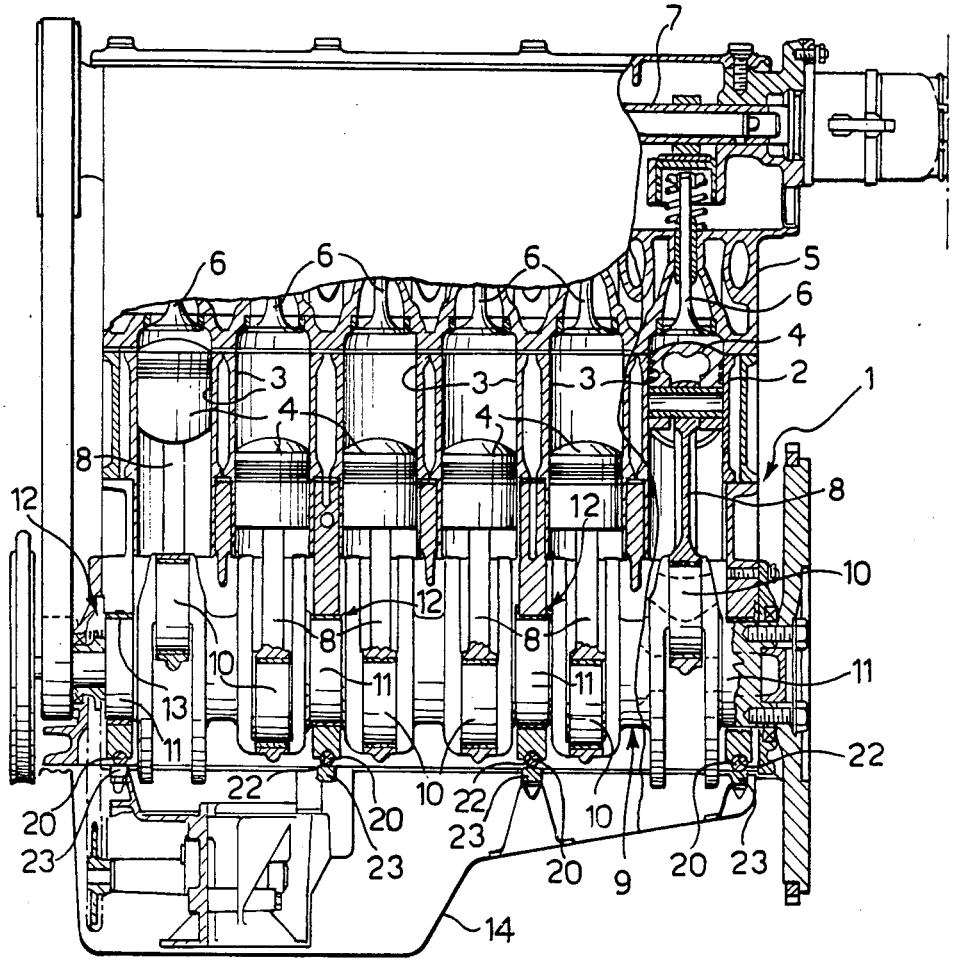
Figure 3:
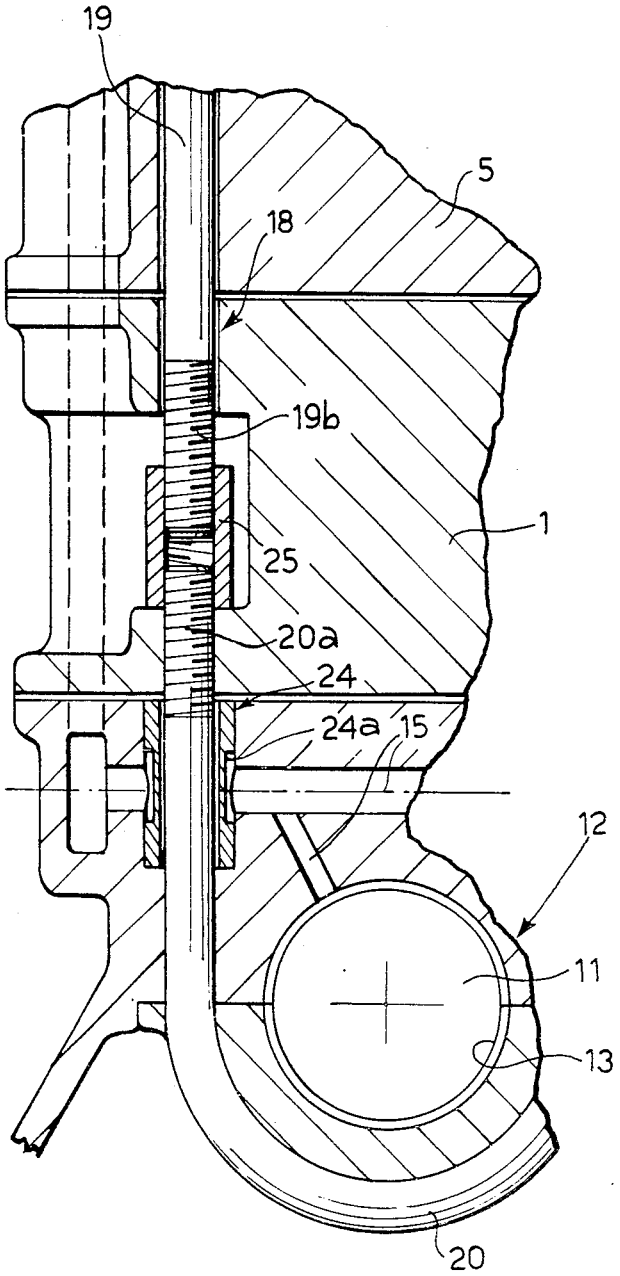

Further characteristics and advantages of the invention will become clearer during the detailed description which follows with reference to the appended drawings, provided purely by way of non-limiting example, in which:

FIG. 1 is a schematic cross-sectional view of an internal combustion engine for motor vehicles according to the invention, FIG. 2 is a longitudinal section of the engine taken on the line II—II of FIG. 1, and FIG. 3 illustrates a variant of a detail of FIG. 1 on an enlarged scale.

The engine illustrated in the drawings comprises essentially an engine block, generally indicated 1, the upper part of which defines a cylinder block 2 defining a plurality of cylinders 3 (six in the embodiment illustrated) in each of which a piston 4 is reciprocable.

The cylinders 3 are closed at their upper ends by a head 5 including the inlet and exhaust ducts with which valves 6 operated by a timing shaft 7 are associated.

The pistons 4 have respective connecting rods 8 connected to a crankshaft 9 in correspondence with crank pins 10. The crankshaft 9 extends through the lower part of the block 1 and has main journals 11 (four in the embodiment illustrated) rotatably supported by respective main bearings, generally indicated 12, with the interposition of plain bearings 13.

A sump 14 for the lubricating fluid of the engine is fixed to the lower part of the engine block 1. In operation, the fluid reaches the bearings 13 of the main journals 11 through passages indicated 15 in FIGS. 1 and 3.

Each of the main bearings 12 includes a portion 16 formed integrally with the block 1 and defining an upper semi-circular-sectioned seat, and a main bearing cap 17 defining a lower semi-circular-sectioned seat joined to the upper portion 16 to complete the housing for the bearing 13 of the respective main journal 11.

According to the invention, the connection of each main bearing cap 17 to the upper portion 16 of the respective main bearing 12 is achieved by means of a connecting member, generally indicated 18, fixed directly to the head 5. The connecting member 18 is constituted by a pair of tie-rods 19 which extend through the block 1 and the head 5 to project from the upper side of the latter, and by a bracket 20 which interconnects the lower ends of the two tie-rods 19. The upper ends of the latter have respective threaded tangs **19*a* on which nuts 21 are screwed to clamp the head 5**.

In the case of FIG. 1, the bracket 20 is formed integrally with the two tie-rods 19. The bracket 20 has a semi-circular arcuate shape and is engaged by form coupling in a peripheral recess 22 (FIG. 2) of complementary shape in the outer surface of the cap 17. In practice, the bracket 20 is pressed resiliently against the housing 22 by a block 23 of elastomeric material supported by the sump 14 and preloaded during fixing thereof to the block 1.

It will thus be clear from the above that the connecting members 18 pass through the block 1 and the head 5 and enable the latter and the main bearing cap 17 to be fixed to the block 1 without a direct mechanical connection to the latter. In correspondence with the portions of the tie-rods 19 intersecting the lubricating passages 15 are located sealing bushes 24 which surround the tie-rods 19 and have outer annular grooves **24*a*** for the passage of the lubricant.

In the variant of FIG. 3, in which parts identical or similar to those described previously are indicated by the same reference numerals, the bracket 20 of each connecting member 18 is constituted by a member separate from the two tie-rods 19 and fixed thereto by a mechanical coupling. This coupling is achieved by means of threaded sleeves 25 screwed onto corresponding threaded tangs **20*a* and 19*b* disposed in correspondence with the facing ends of the bracket 20 an the tie-rods 19**, respectively.

Finally, it should be noted that, in the case of four-cylinder engines with three main bearings or six-cylinder engines with four main bearings, it is possible to use conventional stud bolts for fixing the head 5 to the top of a block in which no main bearings 12 are provided, in addition to the use of the connecting members 18.

Naturally, the constructional details and forms of embodiment of the invention may be varied widely with respect to that described and illustrated, without thereby departing from the scope of the present invention.

I claim:

1. An internal combustion engine for motor vehicles, including an engine block carrying a plurality of cylinders which are closed at their upper ends by a head fixed to the block by tie-rods and in which there are reciprocable pistons connected by respective connecting rods to a crankshaft having main journals supported for rotation by the block in correspondence with respective main bearings, each including an upper portion fixed to the block, a lower cap, and removable connecting members joining the lower cap to the upper portion, wherein the connecting members for each main bearing cap are constituted by a pair of tie-rods anchored at one end to the head, and by a bracket which interconnects the opposite ends of the tie-rods and surrounds the main bearing cap to clamp it against the upper portion of the respective main bearing, wherein the bracket has an arcuate shape and the main bearing cap has a complementary peripheral housing in which the bracket is engaged by form coupling; said engine including a sump for lubricating fluid fixed to the block beneath the main bearing and resilient means interposed between the sump and the bracket for biasing the bracket into the peripheral housing of the main bearing cap.

2. An engine according to claim 1, wherein the bracket and the two tie-rods are formed in one piece.

3. An engine according to claim 1, wherein the bracket is joined to the lower ends of the two tie-rods by threaded couplings.

4. An engine according to claim 1, wherein the block defines passages for the lubrication of the main journals, and wherein sealing bushes with outer annular grooves for the passage of the lubricant are associated with the portions of the tie-rods which intersect the lubrication passages.

* * * * *